US006343951B1

(12) United States Patent
Ono et al.

(10) Patent No.: US 6,343,951 B1
(45) **Date of Patent: *Feb. 5, 2002**

(54) ELECTRICAL CONNECTOR

(75) Inventors: Yasuhiro Ono, Kanagawa; Shinichi Ikemoto, Tokyo, both of (JP)

(73) Assignee: Kel Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/087,610

(22) Filed: May 29, 1998

(30) Foreign Application Priority Data

Jun. 12, 1997 (JP) ..... 9-154689

(51) Int. Cl.[7] ..... H01R 13/73
(52) U.S. Cl. ..... 439/571; 439/108; 439/660
(58) Field of Search ..... 439/571, 65, 108, 439/533, 712, 724, 77, 564, 567, 74, 876, 92, 101, 66, 67, 78, 79, 552, 553, 554, 555, 604, 80, 81, 82, 83, 701, 607

(56) References Cited

U.S. PATENT DOCUMENTS 4,826,440 A * 5/1989 Plocek et al. ..... 439/70
5,478,253 A * 12/1995 Biechler et al. ..... 439/181
5,533,901 A * 7/1996 Hunt et al. ..... 439/79
5,547,385 A * 8/1996 Spangler ..... 439/101
5,582,519 A * 12/1996 Buchter ..... 439/101
5,586,893 A * 12/1996 Mosquera ..... 439/108
D413,576 S 9/1999 Ono
D413,577 S 9/1999 Ono
5,947,767 A 9/1999 Kitamura
D415,997 S * 12/1999 Ono et al. ..... D13/147
6,007,352 A * 12/1999 Azuma et al. ..... 439/108
6,024,608 A * 2/2000 Azuma et al. ..... 439/660
D421,596 S * 3/2000 Azuma et al. ..... D13/147

OTHER PUBLICATIONS

U.S. application No. 09/050800, Azuma et al., filed Mar. 30, 1998.
Specification 29/083360.*

* cited by examiner

*Primary Examiner*—Gary Paumen
*Assistant Examiner*—Ross Gushi
(74) *Attorney, Agent, or Firm*—Robert W. J. Usher

(57) ABSTRACT

Frame grounding fixtures (plug connector fixtures) 40 are provided at the longitudinal ends of the plug housing 10 for mounting the plug connector half 1 on a printed circuit board K1, and receptacle connector fixtures 80 are provided at the longitudinal ends of the receptacle housing 50 for mounting the receptacle connector half 5 on a printed circuit board K5. When the plug and receptacle connector halves 1 and 5 are intermated, the frame grounding fixtures 40 are brought into contact with the receptacle connector fixtures 80 because the contact surfaces of the frame grounding fixtures 40 are provided in the same planes as the inner surfaces 12*c* of the plug housing 10, and the contact surfaces of the receptacle connector fixtures 80 are provided in the same plane as the outer surfaces 52*b* of the receptacle housing 50.

9 Claims, 6 Drawing Sheets

ELECTRICAL CONNECTOR

RELATED APPLICATIONS

This application claims the priority of Japanese Patent Application No. 9-154689 filed on Jun. 12, 1997, which is incorporated herein by reference.

FIELD OF THE INVENTION

The present invention generally relates to an electrical connector assembly of the type having two intermatable, plug and receptacle connector halves; and more particularly to such electrical connector having, in addition to electrical contacts used for signal transmission, electrically grounding metal fixtures that are used for fixing the electrical connector.

BACKGROUND OF THE INVENTION

In a type of electrical connector which comprises plug and receptacle connector halves intermatable for connecting signal lines, each connector half is mounted on a respective printed circuit board, and the grounding connection of each connector half is provided through the corresponding circuit board, respectively.

In this type of connector, there has been known an electrical connector which comprises intermatable plug and receptacle connector halves, each connector half having rows of electrical contacts used for signal transmission.

When the insulative housing of each connector half is mounted on a printed circuit board, the lead portions of the electrical contacts of the respective connector half are soldered to electrically conductive pathways which are provided as a circuit pattern on the respective surface of the printed circuit board. In this condition, each connector half is electrically grounded through some electrical contacts whose lead portions are soldered to electrical pathways which are used for grounding.

Another type of electrical connector of prior art comprises a metallic shield (or a shell) that covers an insulative housing and extends laterally beyond the housing. In this case, the grounding of the connector is provided by means of soldering these laterally extended portions (or fixing portions) of the shell onto electrically conductive pathways which are provided in the circuit pattern of the printed circuit board. In this connector, the fixing portions of the shell, which are connected to the grounding circuit of the printed circuit board, are integrally formed with the shell.

On the other hand, if the connector is constructed to be grounded through some of the electrical contacts which are provided for signal transmission as in the above mentioned former case, then the size of the connector becomes relatively large because the connector requires extra electrical contacts for grounding besides the contacts that are used for signal transmission. These extra contacts present a problem of connector size increase. On the other hand, if the connector is constructed to be grounded through a metallic shell as in the latter case, then not only the size of the connector becomes relatively large but also the weight of the connector becomes relatively heavy because the connector comprises a complex metallic part, i.e., the shell. This presents a problem of connector size and weight increase, which is an obstacle against connector miniaturization.

SUMMARY OF THE INVENTION

The present invention was conceived to solve the above mentioned problems. It is an object of the present invention to provide an electrical connector which can be grounded securely with a simple construction of the connector in a relatively small size.

In order to achieve such objectives, the present invention provides an electrical connector comprising a plug connector half and a receptacle connector half as basic components, which connector halves are intermatable to connect a plurality of plug contacts that are retained for signal transmission in the plug housing of the plug connector half with corresponding receptacle contacts that are retained for signal transmission in the receptacle housing of the receptacle connector half.

Additionally, plug connector fixtures which are formed of an electrically conductive material are provided at the longitudinal ends of the plug housing to fix the plug connector half onto a plug connector-mountable object. Also, receptacle connector fixtures which are formed of an electrically conductive material are provided at the longitudinal ends of the receptacle housing to fix the receptacle connector half onto a receptacle connector-mountable object.

The plug connector fixtures, which are mounted at the longitudinal ends of the plug housing, provide plug contact surfaces which exist in substantially same planes as inner surfaces of the plug housing and adjacent to these inner surfaces. Also, the receptacle connector fixtures, which are mounted at the longitudinal ends of the receptacle housing, provide receptacle contact surfaces which exist in substantially same planes as outer surfaces of the receptacle housing and adjacent to these outer surfaces. When the plug connector half and the receptacle connector half are mated with each other, the plug contact surfaces are brought into contact with the receptacle contact surfaces. In this condition, at least either the plug connector fixtures or the receptacle connector fixtures are electrically grounded through the plug connector-mountable object or the receptacle connector-mountable object, respectively.

In this connector assembly, the contacts for signal transmission and the connector fixtures are aligned longitudinally in a row, and the contact surfaces of the connector fixtures are positioned in the same planes as the outer surfaces and the inner surfaces of the respective housings without protruding outwardly. Therefore, this connector assembly can be miniaturized easily. Moreover, as the contact surfaces of both the connector fixtures are brought into contact with each other when the connector halves are intermated, it is possible to ground both the connector fixtures even if only the connector fixtures of one connector half are connected to the grounding pathways of a respective connector-mountable object.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention and wherein.

DESCRIPTION OF THE PREFERRED EMBODIMENTS

Figure 1:
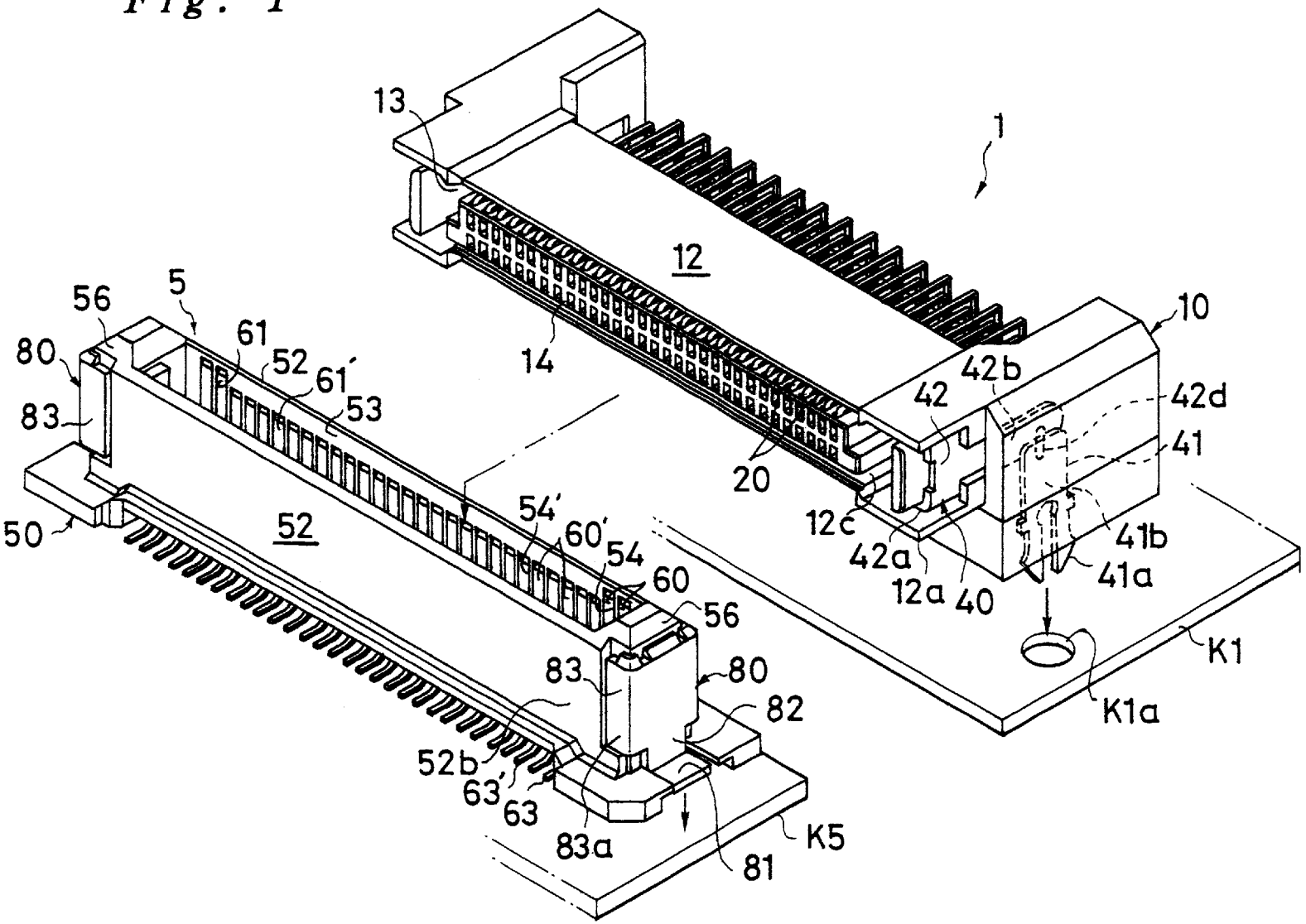
FIG. 1 shows a perspective view of a receptacle connector half and a plug connector half as a preferred embodiment of electrical connector assembly of the present invention.
Figure 2:
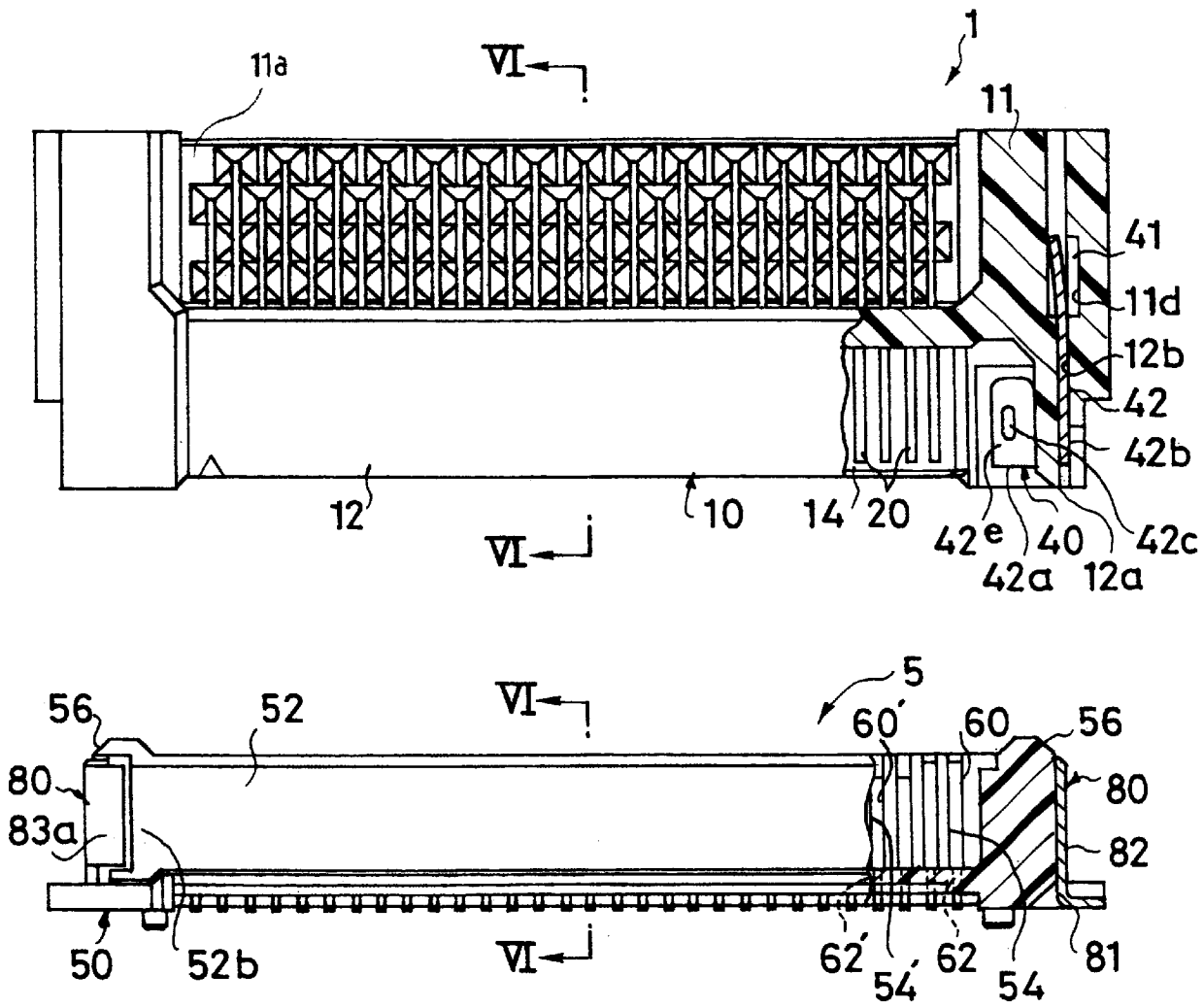
FIG. 2 shows a side view of the electrical connector assembly with partially cut away views taken along lines II—II in FIGS. 3 and 5.
Figure 3:
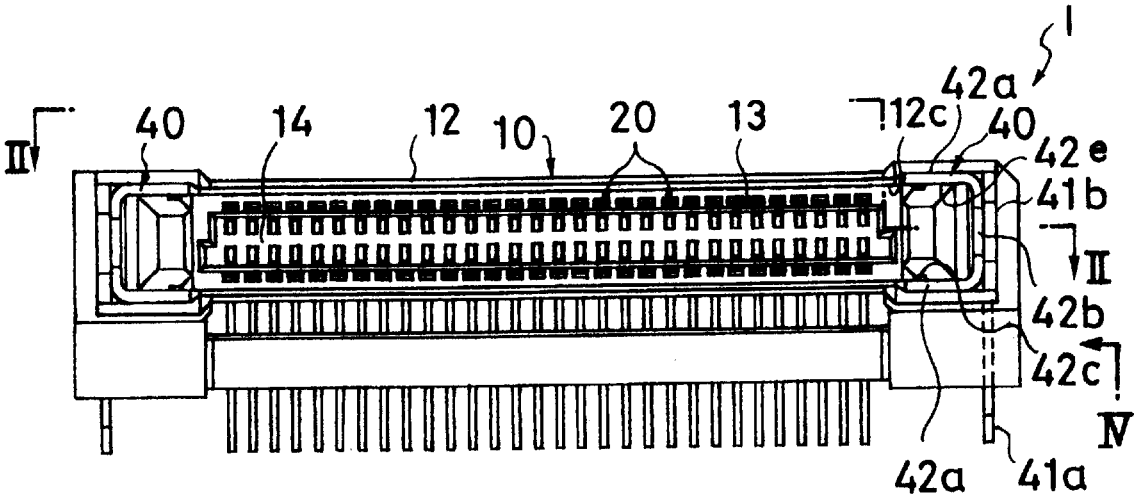
FIG. 3 shows a front view of the plug connector half.
Figure 4:
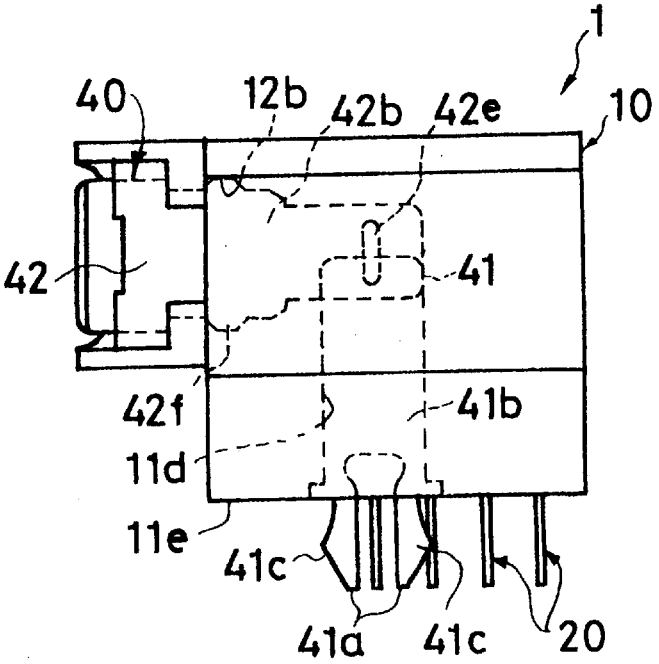
FIG. 4 shows an enlarged view of the plug connector seen in the direction indicated by arrow IV in FIG. 3.
Figure 5:
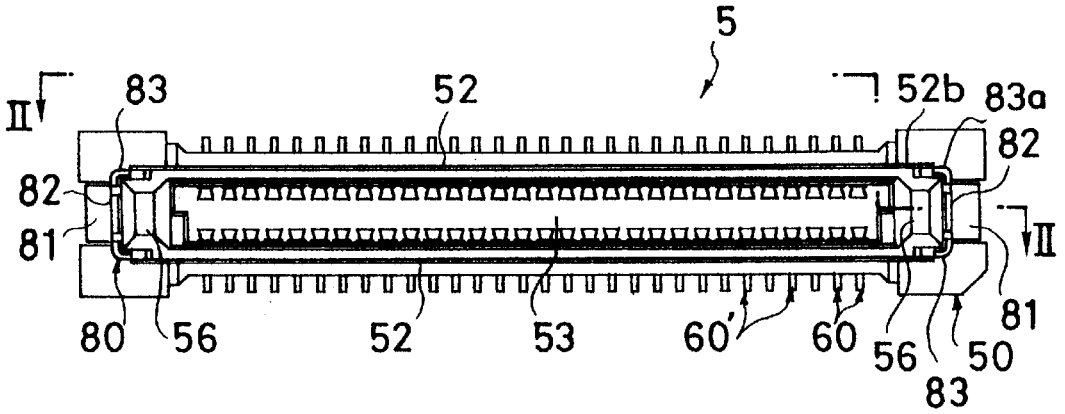
FIG. 5 shows a front view of the receptacle connector half.

An electrical connector is described as a preferred embodiment of the present invention with reference to the drawings. As shown in FIG. 1 to FIG. 6, this electrical connector assembly comprises a plug connector half 1 and a receptacle connector half 5, which are to be mated with each other so that the electrical contacts provided in each connector half are connected with those of the other. In each figure, each connector half 1 or 5 is shown as separated from the other.

First, a description is made of the plug connector half 1. The plug connector half 1 is a right angle type connector and has a plurality of plug contacts 20 retained in a plug housing 10, which is formed of an insulative material as shown in the figures.

The plug housing 10 comprises integrally a rectangular base portion 11 (second member), a rectangular outer wall portion 12 and a plug contact retaining portion 14 (first member). The base portion 11 includes a TPR plate (alignment plate) 11*a*, which is integrally formed therein. On the base portion 11, the outer wall portion 12 is provided extending forward in a form of rectangular box, and the plug contact retaining portion 14 is formed inside the outer wall portion 12 in a one-piece body. As a result, above the base portion 11, an annular plug outer cavity 13 is created opening forward between the outer wall portion 12 and the plug contact retaining portion 14.

Four rows of apertures 18 are provided vertically through the TPR plate 11*a*, which is formed in a one-piece body with the base portion 11 and located at the center of the base portion 11. Furthermore, a plurality of guide grooves 14*a* are provided on the upper and lower outer surfaces of the plug contact retaining portion 14, at locations corresponding to the apertures 18, respectively. As a result, the front portions of the plug contacts 20 stitched into the apertures 18 are guided in the guide grooves 14*a* while the lead portions of the plug contacts 20 pass through the apertures 18.

Each plug contact 20 is formed of an electrically conductive material and includes a contact portion 21, which faces the plug outer cavity 13, being guided by a corresponding guide groove 14*a*, an horizontal portion 22, which extends horizontally from the contact portion 21, and a lead portion 23, which is bent downward from the horizontal portion 22. The contact portions 21 are provided with some resiliency and are formed widening forward, and the rear parts of them are bent inward so that the plug connector half 1 is easily engageable with the receptacle connector half 5, which will be described in detail later.

Furthermore, at the longitudinal ends the plug housing 10, provided are metallic frame grounding fixtures (plug connector fixtures) 40 and 40, which are used for fixing the plug connector half 1 onto a printed circuit board (plug connector-mountable object) K1 as well as for electrically grounding the plug connector half 1 through the printed circuit board K1. These frame grounding fixtures 40 and 40 come into contact with receptacle connector fixtures 80, which are provided in the receptacle housing 50, when the plug connector half 1 and the receptacle connector half 5 are mated with each other as described below.

Each frame grounding fixture 40 includes an anchoring member 41 and a contacting member 42. The anchoring member 41 is formed of a copper plate and comprises a planar fixed portion 41*b* and an insertion portion 41*a*, which extends downward after being bifurcated from the fixed portion 41*b*.

Each insertion portion 41*a*, which is bifurcated, has some resiliency in the direction parallel to the plane thereof and is provided with outward protrusions 41*c*. Therefore, when the insertion portions 41*a* are inserted into through holes K1*a*, which are provided in the printed circuit board K1, the insertion portions 41*a* first close inward to pass the protrusions 41*c* through the through holes K1*a* and then open outward to lock themselves in the through holes K1 with the protrusions 41*c* to fix the plug connector half firmly on the printed circuit board.

Each contacting member 42 comprises a holding portion 42*a*, which is formed in a "C" shape in front view, and a planar retained portion 42*b*, which extends rearward continuously from the holding portion 42*a*. In addition, contact points 42*c*, which protrude inward, are provided on the inside surface of each holding portion 42*a*.

In the lateral front faces 12*a* of the outer wall portion 12, contacting member insertion grooves 12*b* are provided extending rearward, each groove having a depth which can accommodate the retained portion 42*b* of the contacting member 42. The thickness of each contacting member insertion groove 12*b* at the rear part is formed greater than that of the retained portion 42*b* so that the rear portion of each retained portion 42*b* can be elastically bent in the lateral direction (direction leading out of the plane) in a respective contacting member insertion groove 12*b*.

Furthermore, in the lateral lower face 11*e* of the base portion 11, anchoring member insertion grooves 11*d* are provided extending upward each groove having a width and a depth which can accommodate the fixed portion 41*b* of the anchoring member 41. The upper part of each anchoring member insertion groove 11*d* is connected with a respective contacting member insertion groove 12*b*. In this construction, when the fixed portion 41*b* of each anchoring member 41 is press-fit into a respective anchoring member insertion groove 11*d*, which passes vertically through the base portion 11, the upper part of the fixed portion 41*b* protrudes above the base portion 11. Moreover, when the upper part of each fixed portion 41*b* is press-fit into a respective contacting member insertion groove 12*b* of the outer wall portion 12, the base portion 11 and the outer wall portion 12 are combined to form the plug housing.

A contact protrusion 42*d*, which protrudes laterally outwardly, is provided on the retained portion 42*b* of each contacting member 42, which is inserted into a respective contacting member insertion groove 12*b*. Thus, when the retained portions 42*b* are inserted into the contacting member insertion grooves 12*b* respectively, the contact protrusions 42*d* come into contact with the upper parts of the fixed portions 41*b* respectively and shift the retained portions 42*b* laterally inward in the contacting member insertion grooves 12*b*.

Parts of the outer wall portion 12 which face the inward parts of the holding portions 42*a* when the frame grounding fixtures 40 are retained in the plug housing 10 are cut out to expose the contact points 42*c* of the holding portions 42*a* into the plug outer cavity 13. When the frame grounding fixtures 40 and 40 are retained in the plug housing 10, the inner surfaces 42*e* of the holding portions 42*a* of the contacting members 42 are level with the inner surfaces (plug housing inner surfaces) 12*c* of the outer wall portion 12.

After the frame grounding fixtures 40 are solder-plated, the contacting members 42 are press-fit into the front face 12*a* of the plug housing 10, and then, the anchoring members 41 are press-fit into the lower face 11*e* of the base portion 11. As a result, both the members 41 and 42 are brought into contact with each other while the base portion 11 and the outer wall portion 12 are combined with each other. The retained portions 42*b* of the contacting members 42 are provided with retaining protrusions 42*f*, which make the insertion of the retained portions 42*b* easy but prevent them from coming out.

When the retained portions 42*b* are press-fit into the contacting member insertion grooves 12*b* and the fixed portions 41*b* of the anchoring members 41 are press-fit into the anchoring member insertion grooves 11*d*, the fixed portions 41*b* come into contact with the contact protrusions 42*d* of the retained portions 42*b*, with the insertion portions 41*a* of the anchoring members extending downward below the lower face 11*e* of the base portion 11.

The plug connector half 1 in this construction is mounted on the printed circuit board K1 by inserting the lead portions 23 of the plug contacts 20 into the through holes which are provided on the board K1 and by soldering these lead portions to respective electrical pathways that exist in a circuit pattern which is provided on the board (these through holes and the circuit pattern are not shown in the figures). At the same time, the insertion portions 41*a* of the anchoring members 41 of the frame grounding fixtures 40, which are provided at the lateral ends of the plug housing 10, are inserted into the through holes K1*a* of the printed circuit board K1 and are soldered to respective grounding pathways (not shown) in the circuit pattern. As a result, the plug connector half 1 is fixed firmly on the printed circuit board K1.

In this condition, the contact points 42*c*, which are provided on the inside surfaces of the holding portions 42*a* of the contacting members 42, are capable of electrically grounding (earthing) the members of a matable connector half which come into contact (such as receptacle connector fixtures 80, which will be described later) because the contact protrusions 42*d*, which are provided on the retained portions 42*b* of the contacting members 42, are in contact with the anchoring members 41.

As the anchoring members 41 and the contacting members 42 of the frame grounding fixtures 40 are separate parts, the anchoring members 41 can be solder-plated to improve solderability while the contacting members 42 can be nickel-plated or gold-plated to improve the durability of the fixtures for repeated insertion and removal. Therefore, this construction improves the productivity for manufacturing the connector assembly and maintains the electrical conductivity of the anchoring members 41 and the contacting members 42 in good condition.

The plug connector half of the present invention is not limited to the above mentioned construction. It may be constructed as shown in FIGS. 7 through 10. In this plug connector half 101, the TPR plate 111*a* of the base portion 111 is provided removably at the rear part of the outer wall portion 112, and each anchoring member 141 comprises a fixed portion 141*b*, which is formed shorter than the fixed portion 41*b* of the anchoring member 41 of the plug connector half 1. Also, the lead portion 123 of each plug contact 120 used in the plug connector half 101 is shorter than the lead portion 23 of each plug contact 20, which is used in the plug connector half 1.

Now, the receptacle connector half 5 is described. The receptacle connector half 5 comprises a plurality of receptacle contacts 60 and 60', which are retained in a receptacle housing 50 formed of an electrically insulative material as shown in the figures.

Figure 6:
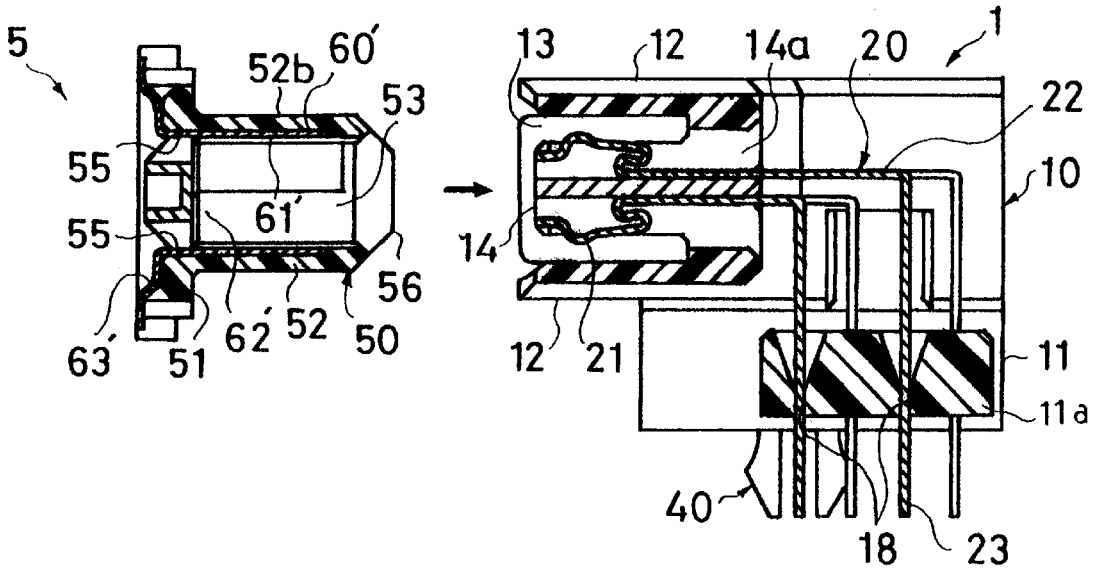
FIG. 6 shows a cross-sectional view of the connector assembly, taken along line VI—VI in FIG. 2.
Figure 7:
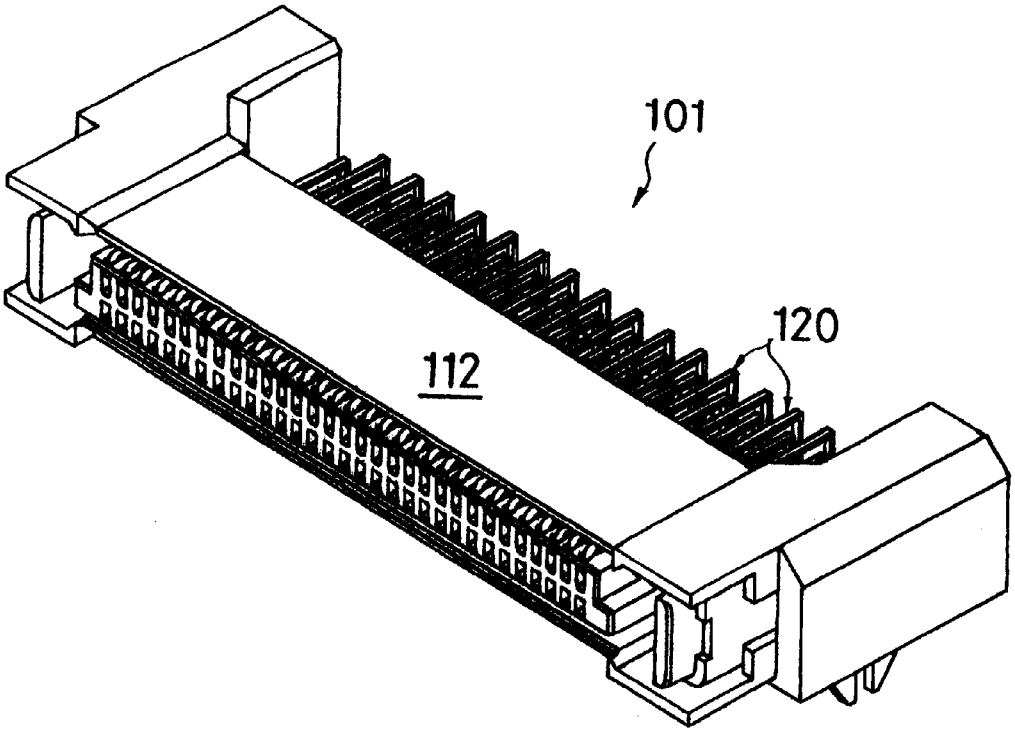
FIG. 7 shows a perspective view of another plug connector half according to the present invention whose construction is different from that of the above embodiment.
Figure 8:
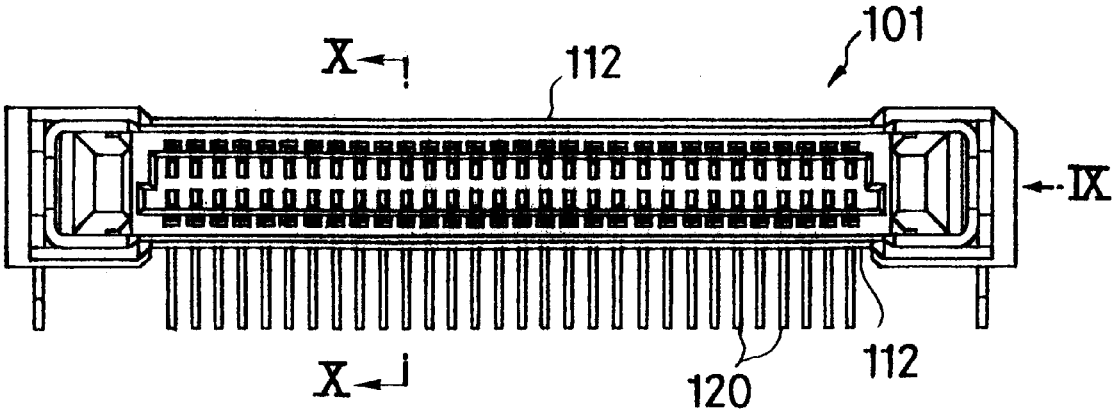
FIG. 8 shows a front view of this plug connector half.
Figure 9:
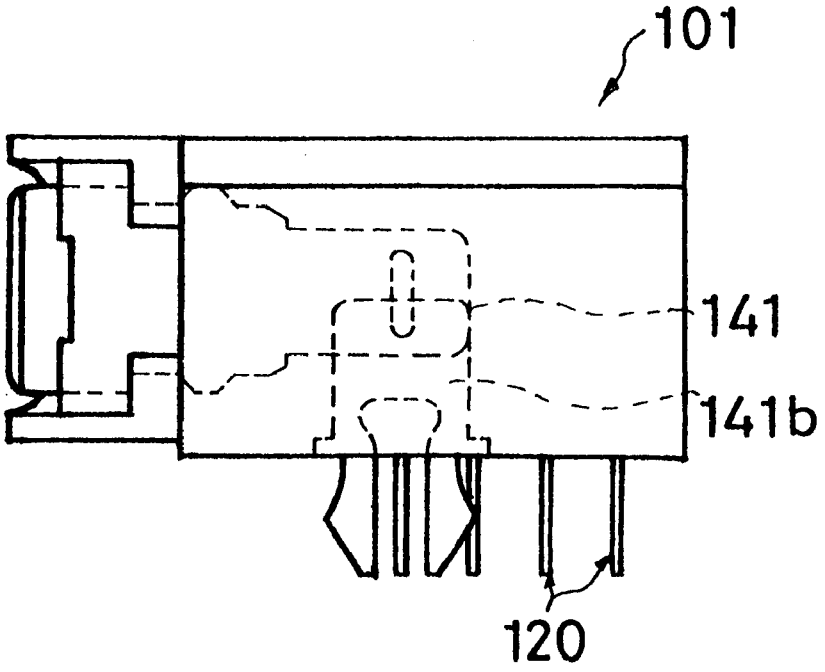
FIG. 9 shows a view seen in the direction indicated by arrow IX in FIG. 8.
Figure 10:
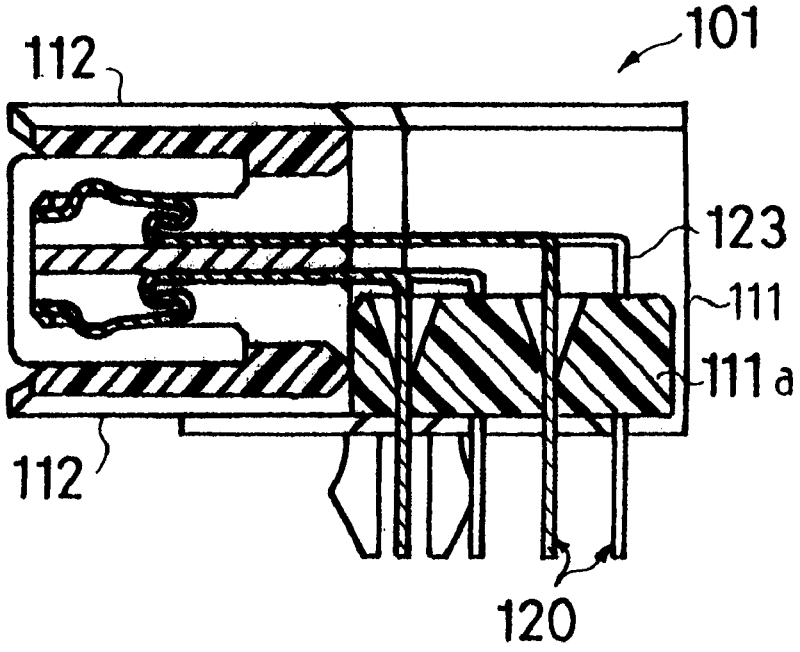
FIG. 10 shows a cross-sectional view taken along line X—X in FIG. 8.

The receptacle housing 50 is integrally formed as a one-piece body having a rectangular base portion 51 and a rectangular side-wall portion 52 upstanding therefrom, forming a receptacle cavity 53 opening to an upper mating face (or opening rightward in the case of FIG. 6). In addition, right and left guiding protrusions 56 and 56, each being formed in a frustum of rectangular cone with a flat top, are provided at the longitudinal ends of the side-wall portion 52.

Two longitudinally extending rows of apertures 55 are formed vertically (horizontally in the case of FIG. 6) through the base portion 51, adjacent to the inner major sides of the side-wall portion 52 in communication with the receptacle cavity 53, and a plurality of guide grooves 54 and 54' are formed on the inner major surfaces of the side-wall portion 52, each groove 54 or 54' being aligned to a respective aperture 55 as shown in the figures. In this construction, the receptacle contacts 60 and 60' stitched into the apertures 55 from the lower side of the housing are guided into the guide grooves 54 and 54', and the upper portions of the receptacle contacts 60 and 60' are retained in the guide grooves 54 and 54'. The guide grooves 54 and the guide grooves 54' are identical in cross section, but the height or length of the guide grooves 54', into which the contact portions 61' of the receptacle contacts 60' are inserted respectively, is shorter than that of the guide grooves 54, into which the contact portions 61 of the receptacle contacts 60 are inserted respectively.

Each receptacle contact 60 comprises a contact portion 61 guided by a corresponding guide groove 54 to face the receptacle cavity 53, an anchoring portion 62 staked into and retained in a corresponding aperture 55, and a lead portion 63 extending laterally from the anchoring portion 62 in a "Z" figure.

On the other hand, each receptacle contact 60' comprises an anchoring portion 62' and a lead portion 63' which are identical to those of the receptacle contact 60, but a different contact portion 61' which is shorter than the contact portion 61 of the receptacle contact 60. Both the receptacle contacts 60 and 60' are formed of an electrically conductive material.

At the longitudinal ends of the receptacle housing 50, provided are metallic receptacle connector fixtures 80 and 80, which are used for fixing the receptacle connector half onto a printed circuit board K5 as well as for electrically grounding the receptacle connector half on the printed circuit board K5. Each receptacle connector fixture 80 includes a flat portion 81, an upright portion 82, which extends upward from the flat portion 81, and a holding portion 83, which is formed in a "C" shape at the top of the upright portion 82.

The receptacle connector fixtures 80 and 80 in this construction are mounted at the longitudinal ends of the receptacle housing 50 with each holding portion 83 holding a respective longitudinal end of the housing. In this condition, the outer major surfaces (outer surfaces of the receptacle housing) 52*b* of the side-wall portion 52 exist in the same planes as the outer side surfaces (receptacle contact surfaces) 83*a* of the holding portions 83.

The receptacle connector half 5 in this construction is mounted on the printed circuit board K5 (receptacle connector-mountable object) by placing and soldering the lead portions 63 and 63' of the receptacle contacts 60 and 60' onto respective electrically conductive pathways which are provided as a circuit pattern (not shown) on the printed circuit board K5 (i.e, the receptacle connector half is surface-mounted). At the same time, the flat portions 81 of the receptacle connector fixtures 80 are surface-mounted on the printed circuit board K5 by placing and soldering the flat portions 81 to respective grounding pathways (not shown) which are provided in the circuit pattern.

When this receptacle connector half 5 is mated with the plug connector half 1, the outer surfaces 83*a* of the holding portions 83 of the receptacle connector fixtures 80 come into contact with the contact points 42*c* of the frame grounding fixtures 40 of the plug connector half 1. Therefore, it is possible to ground both the fixtures 40 and 80 even if only one type of fixtures 40 or 80 are connected to the grounding pathways of either printed circuit board K1 or K5.

When the two connector halves 1 and 5 are intermated, the receptacle contacts 60 and 60' are brought into contact with the plug contacts 20. In this intermating, the receptacle contacts 60, whose contact portions 61 are longer than the contact portions 61' of the receptacle contacts 60', come into contact with the plug contacts 20 before the receptacle contacts 60' come into contact. In this way, the contacts of the connector halves are connected sequentially with a time difference.

Therefore, the receptacle contacts 60 with the longer contact portions 61 may be used for the connection of signals which are desired to be connected first and to be disconnected last while the receptacle contacts 60' with the shorter contacting portions 61' are used for the connection of other signals.

In the above connector assembly, the plug contacts 20 and the receptacle contacts 60 and 60' are described as to be used only for signal transmission. However, the present invention is not limited to this arrangement. Some of the plug contacts 20 and the receptacle contacts 60 and, 60' may be used for grounding connection in addition to the fixtures 40 and 80, which are used for grounding.

Moreover, in the above connector assembly, as the printed circuit boards K1 and K5 are electrically connected through the frame grounding fixtures 40 and the receptacle connector fixtures 80, which are mounted on the printed circuit boards K1 and K5 respectively, any electrical potential difference between the grounding part of the printed circuit board K1 and the grounding part of the printed circuit board K5 is eliminated (or the electrical potentials of both the boards K1 and K5 are made equal to each other), thus reducing the occurrence of noise.

Furthermore, in the above receptacle connector half 5, the flat portions 81 of the receptacle connector fixtures 80 are formed not to extrude from the longitudinal ends of the receptacle housing 50. The present invention is not limited to this construction. The flat portions 81 may be formed extruding from the longitudinal ends of the receptacle housing 50.

Also, the plug connector half 1 may be constructed with fixtures which are formed in a "L" figure like the receptacle connector fixtures so that the plug connector half can be also surface-mounted onto the printed circuit board K1. Conversely, the receptacle connector half 5 may be constructed with fixtures which are formed like the frame grounding fixtures 40 so that the receptacle connector half can be mounted firmly onto the printed circuit board K5. Furthermore, it is not necessary that the plug connector half 1 be a right angle type. Instead, the receptacle connector half 5 may be formed in a right angle type connector.

In the above embodiment, the intermating contact portions (holding portions 42*a* and 83) of the fixtures 40 and 80 are formed in a "U" shape so that the fixtures 40 and 80 are in contact with each other at the upper and lower faces of the plug connector half 1 and at the front and rear faces of the receptacle connector half 5, respectively. However, it is not necessary that these contact portions be formed in a "U" shape. These contact portions can be simply flat plates, and they can be placed at the longitudinal ends of each connector half 1 or 5 respectively for electrical contact.

The invention being thus described, it will be obvious that the same may be varied in many ways. Such variations are not to be regarded as a departure from the spirit and scope of the invention, and all such modifications as would be obvious to one skilled in the art are intended to be included within, the scope of the following claims.

What is claimed is:

1. An electrical connector comprising a plug connector half which retains a plurality of plug contacts in a longitudinally extending row in a plug housing, each plug contact extending in a vertical direction, and a receptacle connector half which retains a plurality of receptacle contacts in a longitudinally extending row in a receptacle housing, each receptacle contact extending in a vertical direction; the receptacle connector housing having a rectangular side-wall portion upstanding therefrom forming an elongate, rectangular mating portion providing a receptacle cavity opening to an upper mating face, the plurality of receptacle contacts being retained in the receptacle cavity;

said plug housing having a mating portion with elongate parallel side walls providing a plug cavity with opposed, inner, longitudinally extending surfaces in which plug cavity the plurality of plug contacts are retained, said plug connector half being matable with said receptacle connector half by receipt of said mating portion of said receptacle housing in the plug cavity to connect the plug contacts with respective corresponding contacts, and said electrical connector further comprising;

plug connector fixtures which are formed of an electrically conductive material and are provided at longitudinal ends of said plug housing to fix said plug connector half on to a plug connector-mountable object; and receptacle connector fixtures which are formed of an electrically conductive material and are provided at opposite longitudinal ends of said rectangular mating portion of said receptacle housing to fix said receptacle connector half on to a receptacle connector-mountable object;

wherein:

said plug connector fixtures, which are mounted at the longitudinal ends of said plug housing, include plug contact surfaces which extend in substantially same planes as said opposed inner, longitudinally extending surfaces of said plug cavity of said plug housing and adjacent to these inner longitudinally extending surfaces;

said receptacle connector fixtures, which are mounted at the longitudinal ends of said rectangular mating portion of said receptacle housing covering respective longitudinal ends of said rectangular mating portion of the receptacle housing so as to define opposite exterior ends of the rectangular mating portion of the receptacle housing include contact surfaces which extend in same planes as outer longitudinal surfaces of said receptacle housing and adjacent to these outer surfaces;

when said plug connector half is mated with said receptacle connector half, said plug contact surfaces are brought into contact with said receptacle contact surfaces; and at least either said plug connector fixtures or said receptacle connector fixtures are electrically grounded through said plug-connector mountable object or said receptacle-connector mountable object, respectively.

2. The electrical connector set forth in claim 1 wherein at least either said plug connector fixtures or said receptacle connector fixtures are surface-mounted on grounding pathways in a circuit pattern which is provided on said plug connector-mountable object or said receptacle connector-mountable object, respectively.

3. An electrical connector as set forth in claim 1 wherein intermating portions of the plug connector fixtures and said receptacle connector fixtures each have arms extending in opposed relation from a bight to form one of a U-shape and a C-shape, said arms providing said plug contact surfaces and said receptacle contact surfaces.

4. An electrical connector as set forth in claim 1 wherein the receptacle connector fixtures hold respective opposite longitudinal ends of the mating portion of the receptacle housing.

5. The electrical connector set forth in claim 1 wherein said plug connector half is a right-angle type connector.

6. The electrical connector set forth in claim 5 wherein:

said plug connector half comprises a first member which includes a plug contact retaining portion and a second member which includes an alignment plate;

said plug contact retaining portion retains contact portions of said plug contacts in alignment; and said alignment plate retains lead portions of said plug contacts in alignment, respectively, each contact portion bending and extending perpendicularly from each lead portion.

7. The electrical connector set forth in claim 6 wherein:

said plug connector fixtures comprise contacting members which are mounted by press-fitting at longitudinal ends of said first member and anchoring members which are mounted by press-fitting at lateral ends of said second member; and said plug contact surfaces are provided on said contacting members.

8. The electrical connector set forth in claim 7 wherein said anchoring members combine said first member and said second member.

9. The electrical connector set forth in claim 7 wherein said anchoring members are solder-plated, and said contacting members are nickel-plated or gold-plated.

* * * * *